US006579146B1

(12) United States Patent
Ganz

(10) Patent No.: US 6,579,146 B1
(45) Date of Patent: Jun. 17, 2003

(54) ROBOTIC SAILING DEVICE AND DESIGN

(75) Inventor: Brian Ganz, San Diego, CA (US)

(73) Assignee: RoboDesign International, Inc., Carlsbad, CA (US)

( * ) Notice: Subject to any disclaimer, the term of this patent is extended or adjusted under 35 U.S.C. 154(b) by 0 days.

(21) Appl. No.: 09/519,905

(22) Filed: Mar. 7, 2000

(51) Int. Cl.[7] ..... A63H 30/04

(52) U.S. Cl. ..... 446/456; 446/176; 446/154; 446/454; 244/16; 280/62

(58) Field of Search ..... 446/456, 176, 446/154; 244/16

(56) References Cited

U.S. PATENT DOCUMENTS 3,395,664 A * 8/1968 Greenberg et al.
3,436,087 A * 4/1969 Noland
D219,372 S * 12/1970 Levy
3,572,740 A * 3/1971 Rypinski
D242,611 S * 12/1976 Schlitter
4,049,287 A * 9/1977 Dudouyt
4,332,395 A * 6/1982 Zech
4,408,772 A * 10/1983 Hollwarth
4,426,806 A * 1/1984 Woodworth
4,886,478 A * 12/1989 Jones
5,024,177 A * 6/1991 Winter et al.

* cited by examiner

*Primary Examiner*—Derris H. Banks
*Assistant Examiner*—Ali Abdelwahed
(74) *Attorney, Agent, or Firm*—John R. Ross; John R. Ross, III

(57) ABSTRACT

A wind propelled vehicle defining a center of gravity. The wind propelled vehicle has a frame. A rear axle is connected to the frame at its rear portion and two rear wheels are rotatably connected to the rear axle. The center of gravity of the wind propelled vehicle is forward of the rear axle. A front wheel is rotatably connected to the frame at its forward portion. A mast is connected to the frame and a boom is connected to the mast. A sail is connected to the mast and boom. A motor is operably connected to the boom and to the front wheel. The motor is also physically connected to the boom. The motor is remotely controlled via a remote control unit. To propel the wind propelled vehicle the position of the sail is adjusted relative to the wind. Sail position adjustment is achieved by the motor turning the front wheel and manipulating the position of the boom in response to control signals generated by the remote control unit.

20 Claims, 10 Drawing Sheets

$$\sum Fy = -ma_n = Fw - Ff$$

$$a_n = R\omega^2 = \frac{v^2}{R}$$

$$Ff = \mu N$$

$$\mu N = Fw - \frac{mv^2}{R}$$

$$\mu 3.55lbf = Fw - \frac{[(3.55lbf)(\frac{1}{32.14\,ft/s^2})(v^2)]}{6.5\,ft}$$

$$\mu 3.55lbf = Fw - [(0.017lbfs^2/ft^2)(v^2)]$$

$$v^2 = \frac{(Fw - \mu 3.55lbf)}{0.017lbfs^2/ft^2}$$

$$v = \sqrt{\frac{(Fw - \mu 3.55lbf}{0.017lbfs^2/ft^2}}$$

$$\sum Mo = Fw * z_{cf} - F_{fr} d_{fr} - F_{sm} d_{sm} - F_{rw} d_{rw} = 0$$

$$Fw(1.67\,ft) = (2lbf * 1.0\,ft) + (1.05lbf * 0.67\,ft) + (0.55lbf * 3.5\,ft)$$

$$Fw = \frac{14.25\,ft * lbf}{1.67\,ft} = 8.55lbf \text{ max}$$

Fw = 8.55 lbf max before tipping $$v = \sqrt{\frac{(8.55lbf - \mu 3.55)}{0.017lbfs^2 / ft^2}}$$

v = the maximum velocity of the Robosailer going into the turn with all the wind force acting perpendicular to the sail to allow sliding before tipping with a wind force $F_w$ of 8.55lbf or a winf Pressure $P_w$ of 1.85 $lbf/ft^2$ At a coefficient of friction of $\mu$ = .10
vmax = 22ft/s

FIG. 7B

ROBOTIC SAILING DEVICE AND DESIGN

TECHNICAL FIELD

The present invention relates generally to the field of robotic sailing devices, particularly robotic sailing devices that are useful on various surfaces including roads, parking lots, grass, dirt, ice, snow and water.

BACKGROUND

Sailing small water craft and windsurfing are popular pastimes with new individuals introduced to the sports every year. Important criteria to the newcomer of these sports are learning and understanding the intricacies of wind, sail and mobility. One method to aid in this learning process is utilization of a remote controlled, wind-propelled vehicle that simulates the physics of windsurfing where one can safely learn how to control and react to diverse wind conditions. In order to more fully simulate the sailing and windsurfing experience the vehicle must be designed to accurately mimic conditions and maneuvers associated with these sports. These include a light weight vehicle with sail and center of gravity forward of the stern or rear axle for maximum wind propulsion, simulation of the physics of lift, and the ability of the vehicle to make tight turns while avoiding the hazard of rollover or capsizing.

Alternatively, the remote controlled, wind-propelled vehicle can be used for entertainment and competition, including the enjoyment of maneuvering and playing with the vehicle on a flat surface and racing the remote controlled vehicles and/or display skills involved in this type of activity. Such remote-controlled vehicles can be a low cost form of learning and entertainment because the power used to propel the vehicle is provided by the wind, thereby the only non-wind power requirement is for the steering of the vehicle.

A wind propelled sail toy vehicle is described in U.S. Pat. No. 4,886,478. This remote controlled land vehicle has a rod-like elongated frame with a mast attachment for a sail and a raised forward portion engaged to a front wheel assembly, plus an elongated axle with wheels at each end. When the sail of the sail toy vehicle is in position, the center of gravity is over the rear axle rather than forward of this location and does not attain maximum wind propulsion. In addition, the lengthy axle assembly of this vehicle is necessary to prevent rollover during sharp turns, inhibiting maneuverability and a more accurate simulation of windsurfing. This vehicle also lacks the option of a frame support reducing the strength of the overall structure.

SUMMARY

The present invention recognizes that existing robotic sailing devices are not particularly agile in that they do not turn or corner well. Furthermore, in operation, existing robotic sailing devices do not obtain a lift vector and thus do not simulate the desirable physics of windsurfing, including speed and agility. The present invention provides a robotic sailing device that is particularly agile, having enhanced speed, turning and cornering capability.

One preferred aspect of the present invention is a wind propelled vehicle that includes a frame that includes a wheel, skid, ski or blade at a distal portion of the frame; an axle that includes two wheels, skids, skis or blades; and a mast. In one preferred aspect of the present invention, a proximal portion of the frame directly or indirectly operably engages the axle.

Optionally, the mast directly or indirectly operably engages the frame at a distal portion of the frame. Preferably, when the wind propelled vehicle is operably engaged with a sail, the center of gravity of the wind propelled vehicle is forward of the axle. In another preferred aspect of the present invention, at least one restraining device directly or indirectly engages the mast and axle and can confine a sail within a determined area and provide a rigid mast support.

Another preferred aspect of the present invention is a wind propelled vehicle that includes at least one frame that includes at least one wheel, skid, ski or blade at a distal portion of the at least one frame; at least one axle that includes at least one wheel, skid, ski or blade; and at least one mast. In one preferred aspect of the present invention, a proximal portion of the at least one frame directly or indirectly operably engages the at least one axle. Optionally, the at least one mast directly or indirectly operably engages the at least one frame at a distal portion of the at least one frame. In another preferred aspect of the present invention at least one restraining device directly or indirectly engages the at least one mast and the at least one axle. Preferably, when the wind propelled vehicle is operably engaged with at least one sail, the center of gravity of the wind propelled vehicle is forward of the at least one axle.

BRIEF DESCRIPTION OF THE FIGURES

FIG. 1A depicts a robotic sailing device of the present invention fitted with a sail, mounting plate to house motors or servos to steer the craft, and wheels. FIG. 1B depicts a robotic sailing device of the present invention with the sail, mounting plate and wheels depicted to indicate the environment of the remainder of the elements of the robotic sailing device.

FIG. 7A and FIG. 7B depicts stability calculations of a robotic sailing device of the present invention. Calculation symbols are defined as: $\mu$, static coefficient of friction; m, mass of robotic sailing device; g, acceleration of gravity; v, linear velocity to entering turn; s, time in seconds; R, turning radius; $P_W$, wind pressure; $F_W$, wind force; A, sail area; $z_{cf}$, center of acting wind force; $F_{fw}$, weight of distal wheel assembly; $F_{rw}$, weight of axle wheel assembly; $F_{sm}$, weight of mounting plate; $F_{fr}$, weight of preferred embodiment of frame, axle and supports; $F_{to}$, weight of preferred embodiment of robotic sailing device; $F_f$, frictional force; $a_n$, normal acceleration; $a_t$, tangential acceleration; $\overline{\omega}$, angular velocity, N, normal force. In the preferred embodiment of a robotic sailing device of the present invention the weight of robotic sailing device is given, mg=3.55 lbf; turning radius measured, R=6.5 ft; A=4.363 $ft^2$; $z_{cf}$=20 in; perpendicular distance of frame to tip axis, $d_f$=12 in; perpendicular distance for axle associated wheel, drw=42 in; perpendicular distance from mounting plate, $d_{rw}$=8 in. Calculations assume robotic sailing device is traveling at a 45 degree and to the wind and therefore all the wind force is acting perpendicular to the sail.

DETAILED DESCRIPTION OF THE INVENTION

Definitions

Figure 1A:
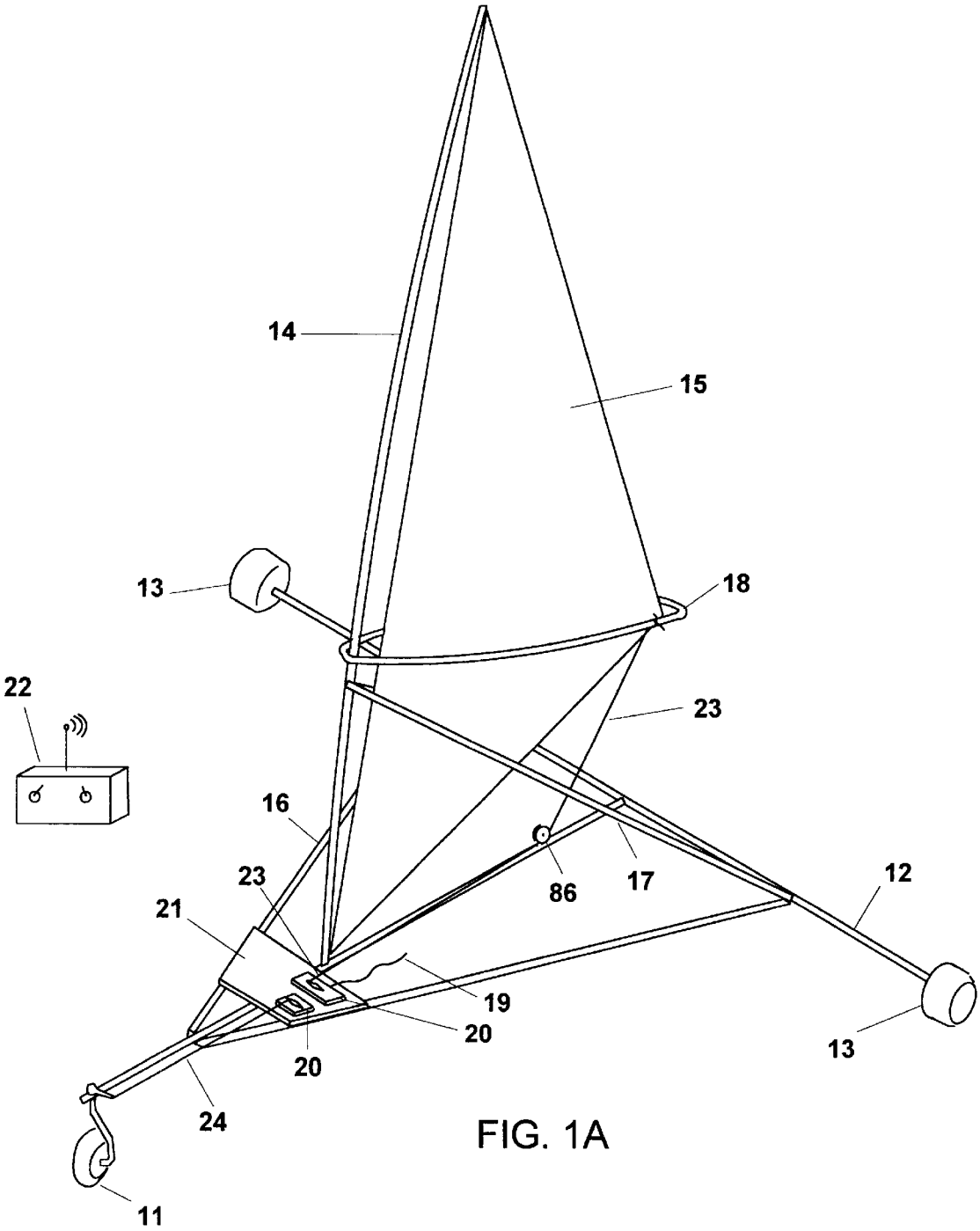
FIG. 1A and FIG. 1B depict one aspect of a robotic sailing device of the present invention viewed from an elevated position.
Figure 1B:
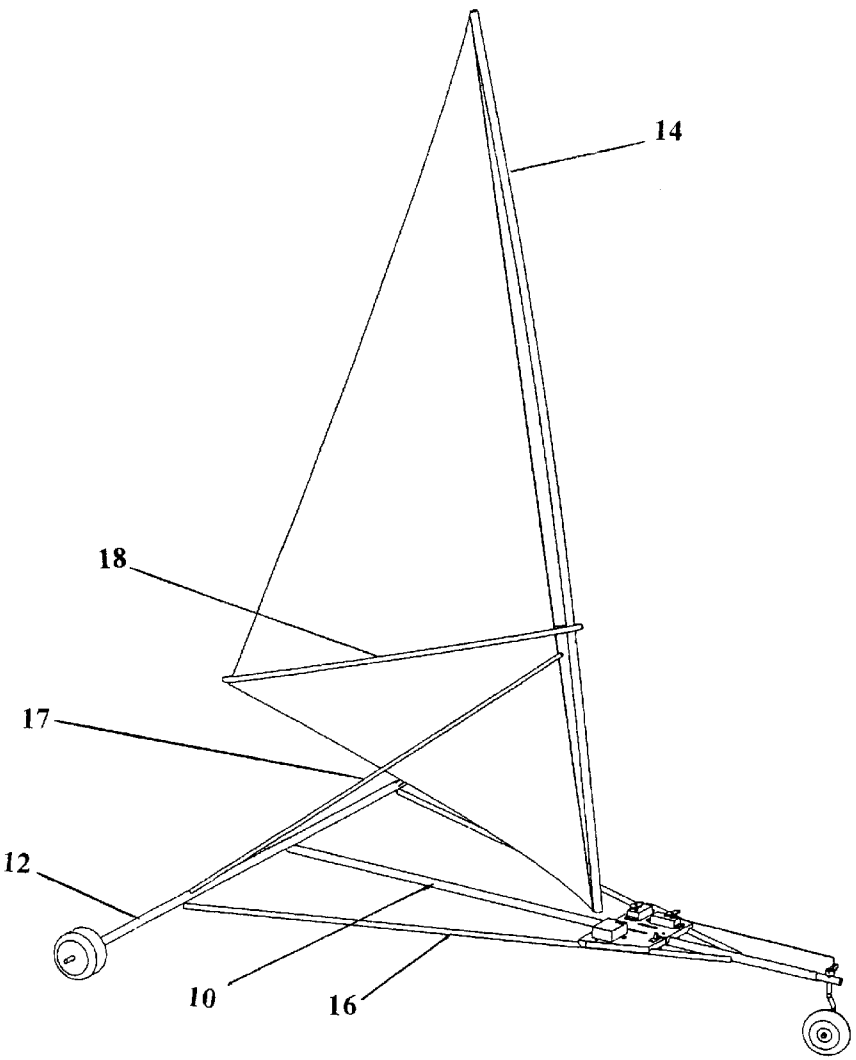
Figure 2:
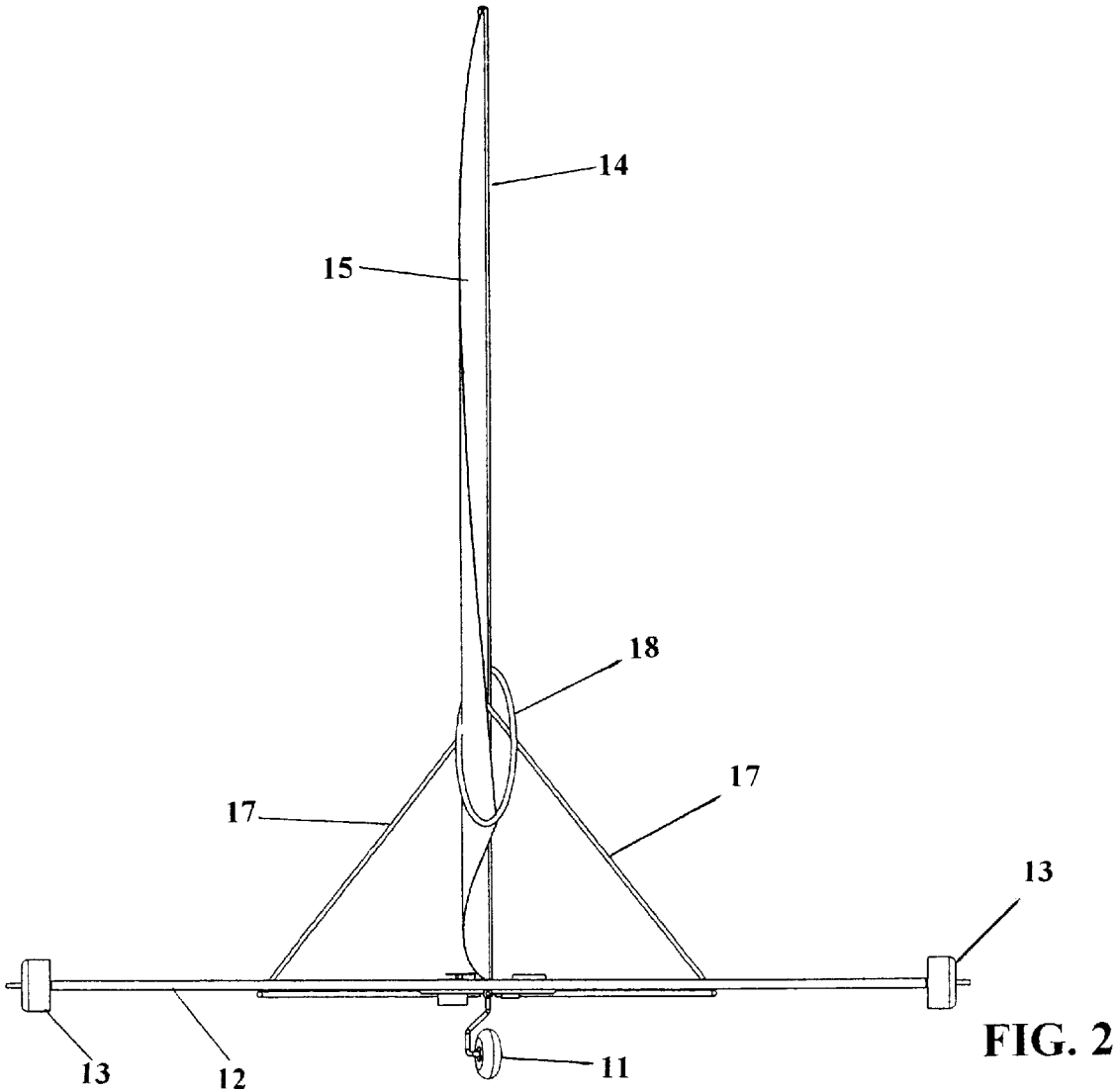
FIG. 2 depicts a front view of one aspect of a robotic sailing device of the present invention where the front wheel assembly, axle with associated rear wheels, mast with attached sail, boom in one position, and retainer apparatus, are depicted.
Figure 3:
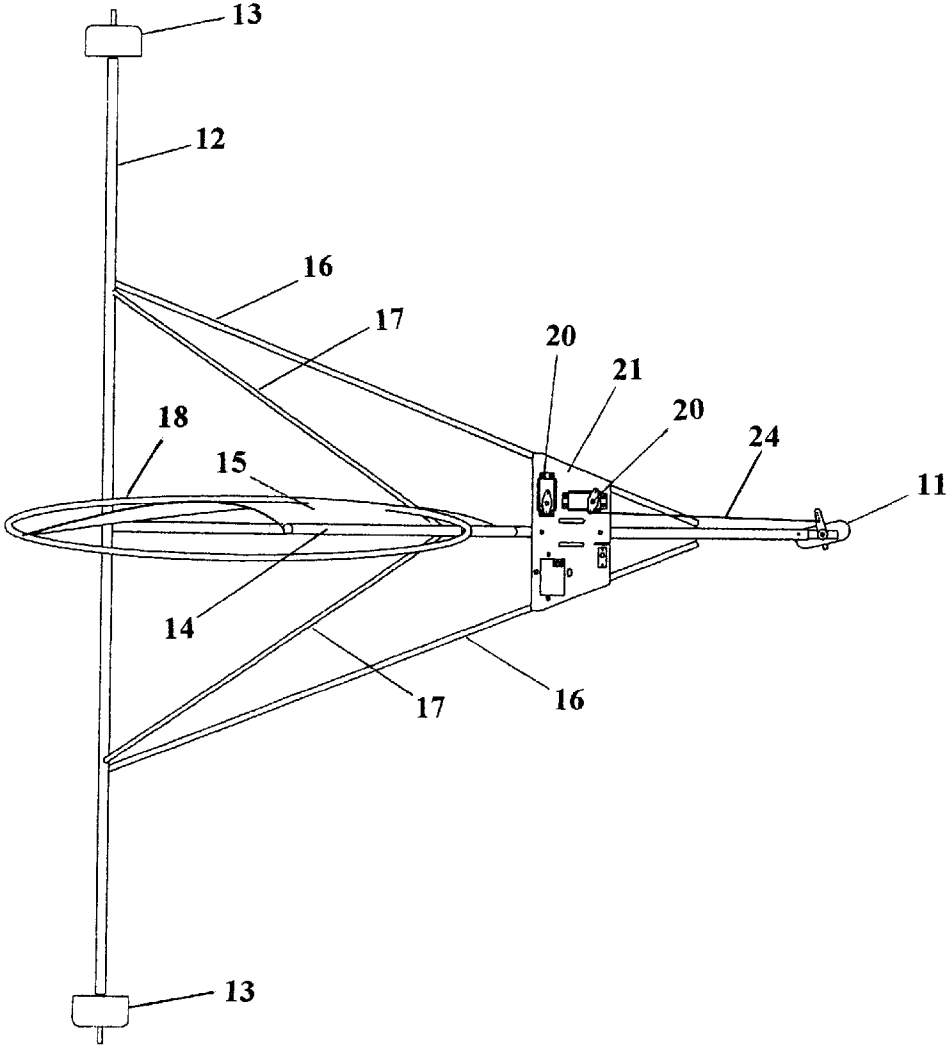
FIG. 3 depicts an overhead view of one aspect of a robotic sailing device of the present invention showing the frame with support beams, mount plate for at least one servo, front wheel assembly, axle with associated rear wheels, mast with attached sail, boom in one position, and retainer apparatus.
Figure 4:
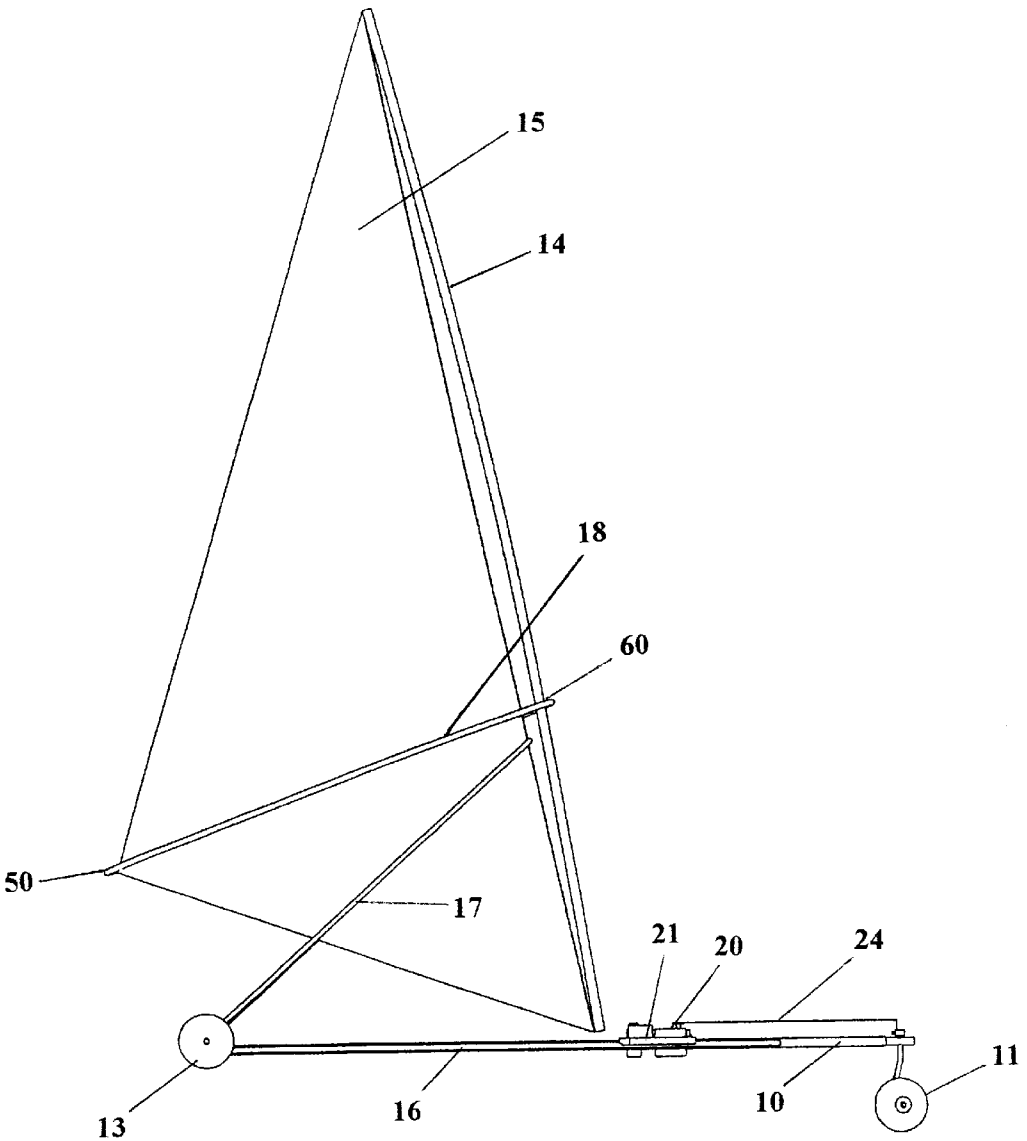
FIG. 4 depicts a side view of a one aspect of robotic sailing device of the present invention shows frame association with front wheel assembly and right rear wheel, mast with attached sail, boom in one position, and retainer apparatus.

Unless defined otherwise, all technical and scientific terms used herein have the same meaning as commonly understood by one of ordinary skill in the art to which this invention belongs. Generally, the nomenclature used herein and the procedures described are well known and commonly employed in the art and in nautical terms. For example, when referring to a frame of a wind propelled vehicle of the present invention, "proximal" can refer to the stem and "distal" can refer to the bow of the wind propelled vehicle. Where a term is provided in the singular, the inventors also contemplate the plural of that term. As employed throughout the disclosure, the following terms, unless otherwise indicated, shall be understood to have the following meanings:

Introductions

As a non-limiting introduction to the breadth of the present invention, the present invention includes several general and useful aspects, including:

1) a wind propelled vehicle that includes a frame that includes a wheel, skid, ski or blade at a distal portion of the frame; an axle that includes two wheels, skids, skis or blades; and a mast.
2) a wind propelled vehicle that includes at least one frame that includes at least one wheel, skid, ski or blade at a distal portion of the at least one frame; at least one axle that includes at least one wheel, skid, ski or blade; and at least one mast.

These aspects of the invention, as well as others described herein, can be achieved by using the methods, articles of manufacture and compositions of matter described herein. To gain a full appreciation of the scope of the present invention, it will be further recognized that various aspects of the present invention can be combined to make desirable embodiments of the invention.

I. A Wind Propelled Vehicle

The present invention includes a wind propelled vehicle that includes a frame 10 that includes a wheel 11, skid, ski or blade at a distal portion of the frame; an axle 12 comprising two wheels 13, skids, skis or blades; and a mast. Optionally, a proximal portion of the frame directly or indirectly operably engages the axle. Optionally, the mast 14 directly or indirectly operably engages the frame at a distal portion of the frame. Optionally, the wind propelled vehicle is operably engaged with a sail 15, resulting in the center of gravity of the wind propelled vehicle being forward of said axle.

In a preferred embodiment of the wind propelled vehicle of the present invention, the frame is 10 elongated. At or near the bow, or distal, end of the frame 10 can be an assembly that directly or indirectly operably engages a wheel 11, skid, ski or blade. The rear, or stern, of the frame is engaged to the approximate center of arn axle 12. Each of the terminal regions or ends of the axle 12 directly or indirectly operably engages a wheel 13, skid, ski or blade. Such a preferred aspect of the present invention is depicted in FIG. 1A, FIG. 1B, FIG. 2, FIG. 3 and FIG. 4.

In this preferred aspect of the present invention two support beams 16 join either side of the frame 10 to the axle 12. One end of each support beam 16 can be joined on either side of the frame 10 with the opposite end of each support beam 16 joined to the axle 12, between the terminal regions or ends of the axle 12 and where the frame 10 engages the axle 12. Attachment of support beams 16 give the vehicle of this invention an overall triangle shape when viewed from overhead. Engaged to the frame 10, at a position within the frame's 10 distal portion but aft of the wheel 11, skid, ski or blade assembly, is a mast 14 that is preferably curved in shape that rises from the frame 10 and sweeps back toward the stem of the frame 10. Attached to the mast 14 can be a sail 15 that can sweep back toward the stem of the vehicle resulting in a center of gravity forward of the axle 12 of the vehicle when being propelled by wind. A restraining device 17 is engaged to the mast 14 such that each end extends to, and can be joined to, the axle 12 at approximately the same position of each of the support beams 16. Preferably, one or more booms 18, such as in a windsurfing configuration, is operably engaged to the mast 14.

Preferably, the invention includes an antenna 19 that can be attached to any portion of the remote-controlled, wind propelled vehicle such as the mast 14 or frame 10 and engages a motor 20 or servo 20 attached to a mounting plate 21, which is in turn attached to the frame 10 or support beam 16 or beams. The motors 20 or servos 20 can be controlled by a remote control device 22 that includes controls, such as joysticks, to modulate the motor 20 or servo 20, preferably independently. One motor 20 or servo 20 preferably is operably engaged to the front wheel 11 by a steering device 24 such as wire and can change the direction of the robotic sailing device while under way. Another motor 20 or servo 20 is preferably operably engaged to the sail 15 or boom 18 by a sail modulating device 23 such as a string, which can act as a main sheet in a sail boat. In operation, the restraining device 17 prevents the sail 15 from progressing too far to port or starboard, while the sail modulating device 23 can change the attitude of the sail 15 relative to the wind and allow for trimming of the sail 15 to provide acceleration or deceleration of the robotic sailing device while under way.

In a preferred aspect of the present invention two restraining devices 17 join the mast to another portion of the robotic sailing device, such as the axle 12. One end of each restraining device 17 can be joined to either side ofa mast 14 with the opposite end of each restraining device 17 joined to the axle 12, between the terminal regions or ends of the axle 12 and where the frame 10 engages the axle 12. Attachment of restraining devices 17 can keep a sail 15 confined to a determined region and provide a rigid support to the mast 14 to reduce or eliminate the requirement of a forestay, such as a front wire.

Figure 5:
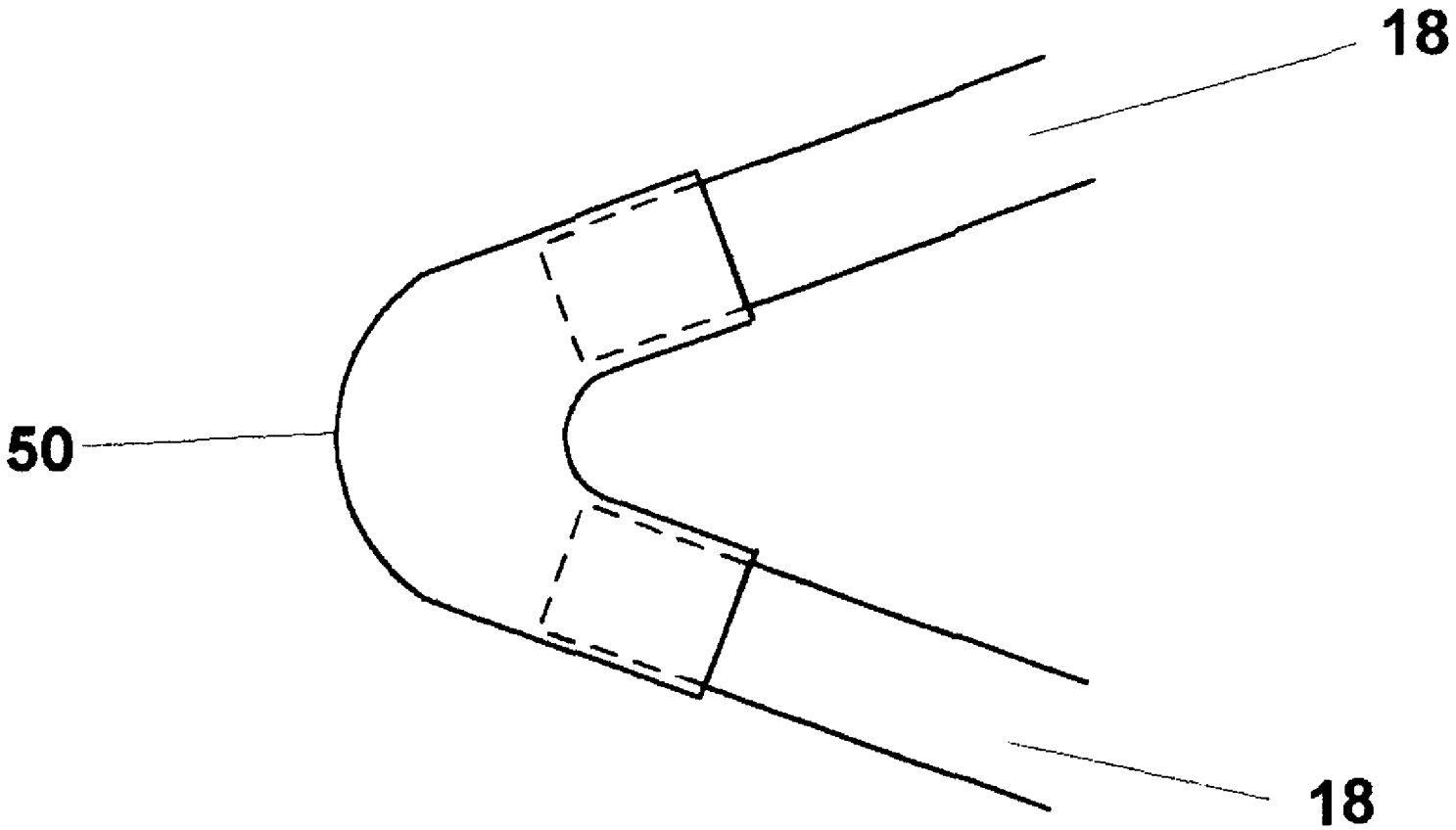
FIG. 5 depicts one aspect of tubing that can attach various elements of a robotic sailing device of the present invention, preferably such that the robotic sailing device can be readily folded for storage or transportation. Depicted are two restraining devices connected by Tygon™ tubing that can be indirectly engaged to the mast.
Figure 6:
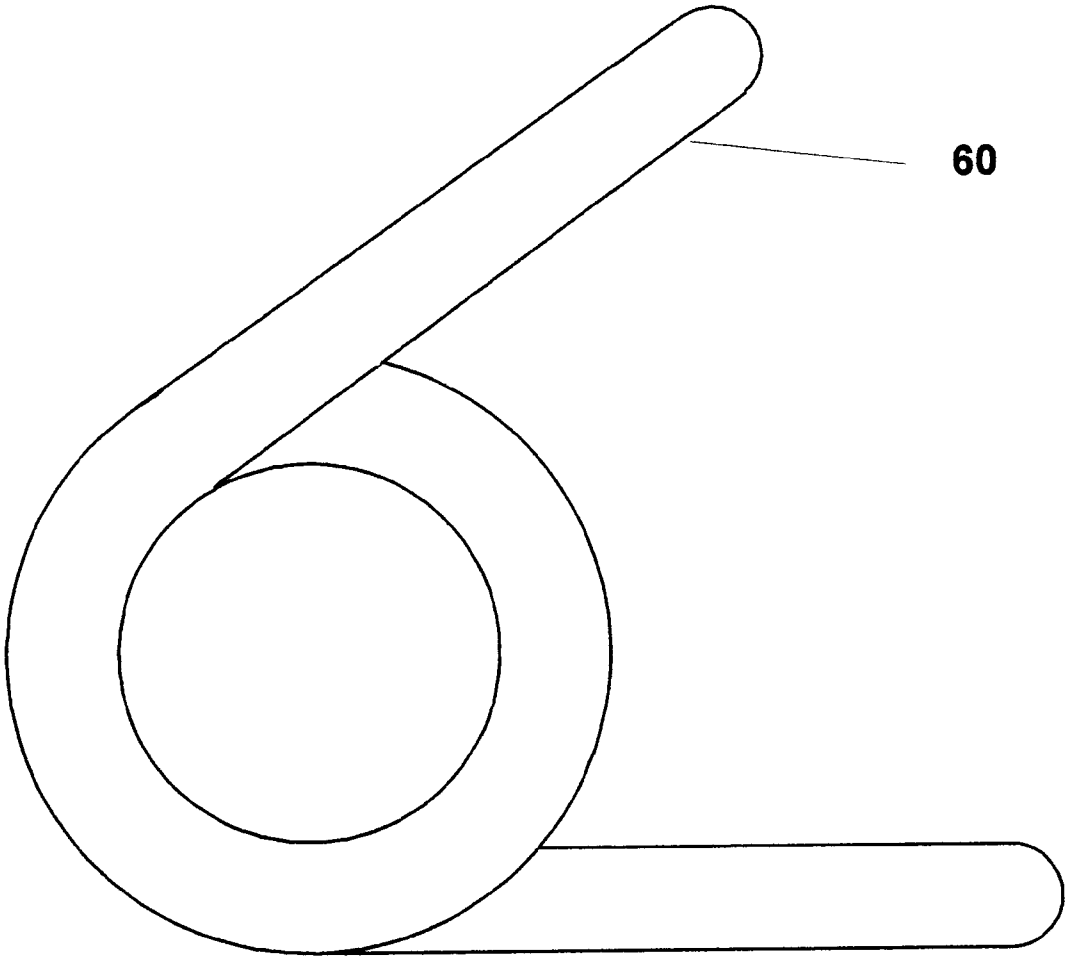
FIG. 6 depicts one aspect of a front wishbone that can directly or indirectly engage a mast to a boom of a robotic sailing device of the present invention.

Each of the attachments of the various elements of the present invention can be quickly engaged or disengaged from their appropriate positions of the wind propelled vehicle of the present invention without necessity of tools. The attachments are joined by clamps, wing-nuts, and flexible tubing 50 such as Tygon™, where one end of the tubing 50 fits over the end of one attachment and the second end can fit over a second attachment thus joining the two, as depicted in FIG. 5, or be joined to the second attachment by an appropriate method or device such as a pin, screw, tie down, wire, twine, snap, or clamp. Velcro™ also can be utilized to join different attachments particularly the mast 14 to the sail 15 using loops of Velcro™ material. String, twine or rope can also be used, particularly for attaching the clew of the sail 15 to the aft portion of the booms 18. This allows for easy transportation and minimal storage requirements and for quick assembly and disassembly without the need of tools. Preferably, the folded and/or disassembled robotic sailing device of the present invention can be stored in a carrying device such as a bag or box. Elements can be directly engaged, meaning the elements physically touch one another, by permanent or semi-permanent attachments such as welds or solder or by temporary attachments such as by screws, bolts, wing-nuts, twine, tubing or the like. Elements can be indirectly engaged, meaning the elements physically do not touch one another directly, by permanent, semi-permanent, or temporary attachments. Such indirect engagement preferably utilizes an additional element, such as tubing 50. An example of indirect engagement is provided in FIG. 5.

Preferably, the mast 14, booms 18, axle 12, frame 10, supports 16 and restraining devices 17 of a wind propelled vehicle of the present invention are all made of rigid tubes and joined by flexible tubing 50. Thus, a wind propelled vehicle of the present invention can be "totally tubular."

Frame

A frame 10 of a wind propelled vehicle of the present invention can be of any shape including, but not limited to, an elongated pole or bar, or, as viewed from overhead a triangle, square, rectangle, oval, or circle. A pole or bar can be solid, perforated or hollow with a cross section of any geometric shape including, but not limited to, cylindrical, square, rectangular, or octagonal. The frame 10 can be, at least in part, a structure such as a platform and can be of any thickness, length and width and can be solid, perforated or hollow. Alternatively, the frame 10 can be constructed of, at least in part, tubes, poles or bars that can be, at least in part solid, perforated or hollow with a cross section of any geometric shape including, but not limited to, cylindrical, square, rectangular, or octagonal. Materials used to make up the frame 10 can be of a single or combination of materials such as, but not limited to, fiberglass, carbon, graphite, plastic, rubber, wood, and metal or metallic elements such as, but not limited to, aluminum, copper, and tin.

The distal region or end of the frame 10 can directly or indirectly, by way of an intermediate attachment, engage a rotatable wheel 11, skid, ski or blade. A rotatable wheel 11 allows for rolling over a somewhat smooth and flat surface including hard composites such as pavement and asphalt, and packed earth. A skid acts as a runner to navigate over such surfaces as grass, sand and ice. Similarly a ski having a flat surface can navigate over similar surfaces and more efficiently over snow. And a blade, such as a skate, best glides over a slick, flat surface such as ice.

The proximal region or end of the frame 10 can directly or indirectly engage an axle 12. The proximal region or end of the frame 10 can directly or indirectly engage an axle 12 by way of, at least in part, but not limited to, clamps, wing-nuts, tubing, plastic, Velcro™, nylon, wire, twine, or cloth. Tubing 50 can be used to engage the frame to the axle by having each attachment fastened into different ends of tubing 50, or, the frame can be engaged to an axle 12 by being wrapped or strapped together, at least in part, with plastic, Velcro™, nylon, wire, twine, or cloth.

Axle

An axle 12 of a wind propelled vehicle of the present invention can be of any shape including, but not limited to, a tube, rod, pole or bar, and can be a single or multiple of pieces. The axle 12 can be, at least in part, solid, perforated or hollow with a cross section of any geometric shape including, but not limited to, cylindrical, square, rectangular, or octagonal. The axle 12 can be made of a single or combination of several materials such as, but not limited to, fiberglass, graphite, plastic, rubber, wood, and metal or metallic elements such as, but not limited to, aluminum, copper, and tin. The terminal regions or ends of the axle 12, or any part of the axle, can directly or indirectly engage any combination of rotatable wheels 13, skids, skis or blades.

Support

A support or supports 16 of a wind propelled vehicle of the present invention can be directly or indirectly engaged to, for example the frame 10 and axle 12. The support or supports 16 can add strength to the overall structure of the invention and increase stability while turning or cornering when being propelled by wind. Each support 16 can be of any form including, but not limited to, a tube, shaft, rod, rail, wire, rope or strap and can be a single or multiple of pieces. A shaft, rod, or rail can be solid, perforated or hollow with a cross section of any geometric shape, but not limited to, cylindrical, square, rectangular, or octagonal. Each support 16 can be made of a single or combination of several materials such as, but not limited to, fiberglass, graphite, plastic, rubber, wood, and metal or metallic elements such as, but not limited to, aluminum, copper, and tin. Each support 16 can be engaged to, but not limited to, the frame 10 and axle 12 by way of, at least in part, clamps, wing-nuts, tubing 50, plastic, Velcro™, nylon, wire, twine, or cloth. Each support 16 can be attached over, on or to, but not limited to, the top, bottom or side of a platform-like frame 10.

Mast

A mast 14 of a wind propelled vehicle of the present invention can be of, at least in part, any form including, but not limited to, a tube, shaft, rod or bar and can be a single or multiple of pieces. The mast 14 can be, at least in part, solid, perforated or hollow with a cross section of any geometric shape including, but not limited to, cylindrical, square, rectangular, or octagonal. The mast 14 can be made of a single or combination of several materials such as, but not limited to, fiberglass, graphite, plastic, rubber, wood, and metal or metallic elements such as, but not limited to, aluminum, copper, and tin. An end or a terminal region of the mast 14, or any part of the mast, can directly or indirectly engage, but not limited to, the frame, preferably within, the proximal half the frame 10. The mast 14 can directly or indirectly engage a frame 10 by way of, at least in part, clamps, wing-nuts, tubing 50, plastic, Velcro™, nylon, wire, twine, or cloth.

Boom

The wind propelled vehicle of the present invention can have at least one boom 18. The at least one boom 18 are preferably two booms 18 in a windsurfing configuration. The at least one boom 18 is, at least in part, any form including, but not limited to, a tube, shaft, rod or bar and can be a single or multiple of pieces. The at least one boom 18 may be made of a single or combination of several materials such as, but not limited to, fiberglass, carbon, plastic, rubber, wood, and metal or metallic elements such as, but not limited to, aluminum, copper, and tin.

The preferably two booms 18 can be engaged at one end or terminal region of each of the preferably two booms 18 to make up the forward end of the at least one boom 18 by, but not limited to, preferably a front wishbone or tubing, plastic, Velcro™, nylon, wire, twine, or cloth. A front wishbone can encircle the mast or attach the mast by way of, for example, clamps or wing-nuts, or being wrapped or strapped together with plastic, Velcro™, nylon, wire, twine, tubing 50, or cloth. A front wishbone can be, but is not limited to, pig tail shaped or curved and can be, at least in part, solid, perforated or hollow. A front wishbone can be made of a single or combination of several materials such as, but not limited to, fiberglass, graphite, plastic, rubber, and metal or metallic elements such as, but not limited to, steel, aluminum, copper, and tin. A front wishbone can attach the preferably two booms 18 by, for example, tubing, wrapped or strapped that can, but is not limited to, encase and join the ends of the preferably two booms 18 to form the forward section of the at least one boom 18. Alternatively, the end or terminal regions of the preferably two booms 18 can be joined by tubing 50, clamps or wing-nuts, or being wrapped or strapped together with plastic, Velcro™, nylon, wire, twine, or cloth. The front or forward section of the at least one boom 18 can be engaged to the mast 14 by, but not limited to, tubing 50 or wrapped or strapped with plastic, Velcro™, nylon, wire, twine, or cloth.

The rear end or aft of the at least one boom 18 can be formed by the preferably two booms by engaging the opposite or rear ends or terminal regions of each of the preferably two booms by, but not limited to, preferably a rear wishbone or clamps, wing-nuts, tubing, plastic Velcro™, nylon, wire, twine, tubing 50 or cloth. A rear wishbone can be, but is not limited to, curved and can be, at least in part, solid, perforated or hollow. A rear wishbone can be made of a single or combination of several materials such as, but not limited to, fiberglass, graphite, plastic, rubber, and metal or metallic elements such as, but not limited to, aluminum, copper, and tin. A rear wishbone can attach the preferably two booms by, but is not limited to, tubing, wrapped or strapped that can, but is not limited to, encase and join the rear ends of the preferably two booms to form the rear section of the at least one boom.

Restraining Device

The wind propelled vehicle of the present invention may have at least one restraining device 17 to keep the sail 15 of the vehicle confined to a determined area thereby preventing an undesirable shift in the center of gravity that can adversely affect performance of the vehicle. The at least one restraining device directly or indirectly engages the frame 10, axle 12, mast 14, or boom 18. The at least one restraining device 17 is of any form or combination thereof including, but not limited to, a tube, shaft, rod, rail, wire, rope, or strap and can be a single or multiple of pieces. A shaft, rod, or rail can be solid, perforated or hollow with a cross section of any geometric shape, but not limited to, cylindrical, square, rectangular, or octagonal. The at least one restraining device 17 can be made of a single or combination of several materials such as, but not limited to, fiberglass, graphite, nylon, plastic, rubber, wood, and metal or metallic elements such as, but not limited to, aluminum, copper, and tin. The at least one restraining device 17 can be engaged to, but not limited to, the frame 10, axle 12 and mast 14, by way of, at least in part, clamps, wing-nuts, tubing 50, plastic, Velcro™, nylon, wire, twine, or cloth.

A preferred embodiment of the present invention can have an end of the at least one restraining device 17 engaged to the mast about, but not limited to, the midsection of the mast 14. The opposite end of the at least one restraining device 17 can be attached to another portion of the robotic sailing device, such as the axle 12. Dependent upon its material makeup the at least one restraining device 17 can receive pressure, such as compression, and support to the mast 14. In one aspect of the present invention the need of a forestay, such as a wire, to support the mast 14 can be eliminated.

Sail

The wind propelled vehicle of the present invention can have a sail 15 that directly or indirectly engages one or more of, or any combination thereof, the mast 14, frame 10, axle 12, at least one boom 18, or at least one restraining device 17. The sail 15 is of any shape including, but not limited to, a triangle, square, rectangle, oval or circle or can be a solid wing sail. The sail 15 can be a single or multiple of pieces of one or more same or different materials. The area of the sail 15 can be of any size such as between about 0.5 to about 10 square feet, preferably between about 2 to about 8 square feet, and more preferably between about 3 to about 6 square feet. Preferably, the sail 15 has the shape and is made of the same or similar material or materials as are windsurfing sails. In one preferred aspect of the present invention the sail 15 has a windsurfing configuration which in operation prevents, at least in part, a lift vector on the boom or booms 18. In this configuration, the need for a downstay is reduced or eliminated.

The sail 15 consists of any one or a combination of materials such as, but not limited to, Mylar™, plastic, nylon, paper, cloth, or canvas or any combination thereof. The sail 15 can directly or indirectly engage the mast 14, frame 10, axle 12, at least one boom 18, or at least one restraining device 17 of the wind propelled vehicle, at least in part, by such means as, but not limited, to clamps, wing-nuts, tubing, Velcro™, nylon, wire, twine, cloth, and plastic. The sail 15 can utilize the wind to propel the vehicle forward as understood by those familiar with the art. The sail 15 can be confined to an area by at least one restraining device 17 while the motion and position of the sail 15 can be controlled by a sail modulating device. In one aspect of the present invention, the sail 15 can include battens to provide rigidity, shape and strength to the sail. In the alternative, the sail 15 can be provided without battens and be cut to allow a curved leading edge of the sail when underway and full of wind.

Steering Device

The wind propelled vehicle of the present invention can have at least one steering device that can modulate the direction of the robotic sailing device while underway. Preferably the steering device modulates the angle of the front wheel, ski, skid or blade to effect a change in direction. The steering device is preferably directly or indirectly engaged with the front wheel 11, ski, skid or blade by an appropriate structure, such as a wire. The at least one steering device can include at least one motor 20 or servo 20 that can modulate the front wheel 11, ski, skid or blade, preferably under remote control direction of a user, such as a human operator using a remote control device 22. The motor 20 or servo 20 can be located at any appropriate location on the robotic sailing device, but is preferably located on the frame 10 and/or support 16, and is preferably provided on a mounting structure, such as a mounting plate 21.

Sail Modulating Device

The wind propelled vehicle of the present invention may have at least one sail modulating device. The at least one sail modulating device can include at least one motor 20 or servo 20. The at least one sail modulating device can directly or indirectly modulate the sail 15, preferably using configurations known the nautical arts, such as configurations of a main sheet in a sailboat. For example, a modulating device 23, such as a string, can be modulated using a motor 20 or servo 20 under control of, for example, a remote control device 22. The string can be attached to the sail 15 or boom 18 or booms 18 to allow the sail 15 to be sheeted in or sheeted out by an operator as appropriate or desired. A pulley, restraint or system of pulleys or restraints can be used to direct the course of the string along the robotic sailing device. For example, FIG. 1A shows modulating device (i.e., string) 23 tied to boom 18 at one end. At its other end, modulating device 23 is connected to motor 20. Between motor 20 and boom 18, modulating device 23 is directed through pulley 86.

Embodiments Utilizing Skis, Skids and Blades

Figure 8:
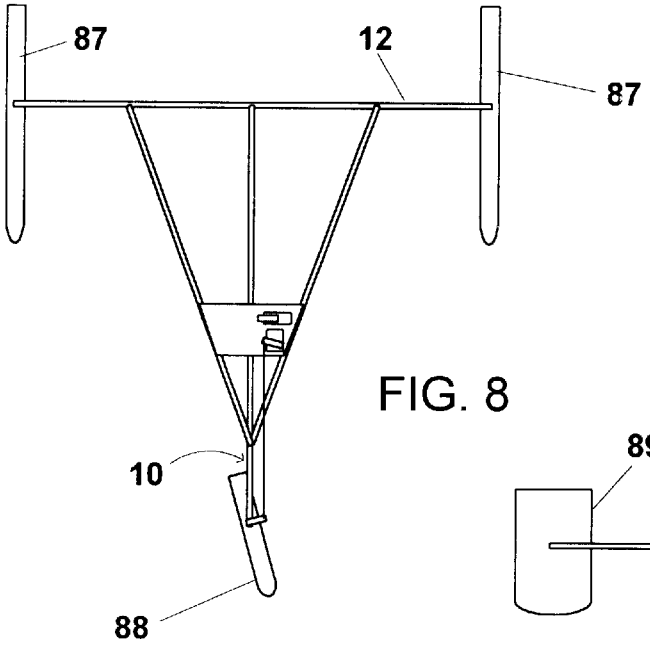
FIG. 8 shows another preferred embodiment of the present invention.
Figure 9:
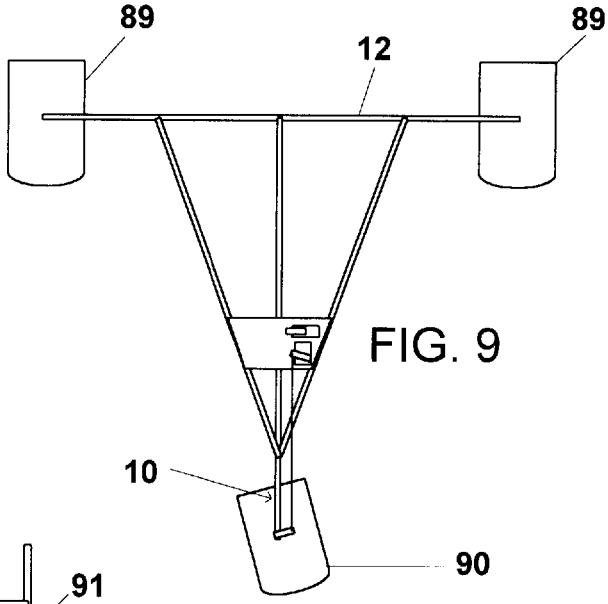
FIG. 9 shows another preferred embodiment of the present invention.
Figure 10:
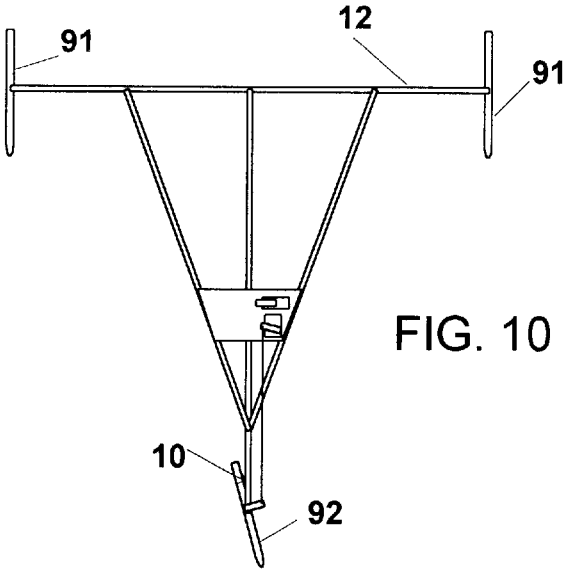
FIG. 10 shows another preferred embodiment of the present invention.

As stated repeatedly above, it is possible to utilize the present invention with skis, skids and blades in place of wheels. For example, FIG. 8 shows skis 87 connected to rear axle 12 and ski 88 connected to the forward portion of frame 10. FIG. 9 shows skids 89 connected to rear axle 12 and skid 90 connected to the forward portion of frame 10. Likewise, FIG. 10 shows blades 91 connected to rear axle 12 and blade 92 connected to the forward portion of frame 10.

Dimensions

The ratio of axle 12 length to frame 10 length of a wind propelled vehicle is preferably between about 1:1 and about 2:1. More preferably, that ratio is about 1.2:1, about 1.4:1, about 1.6:1 or about 1.8:1. This ratio allows for the wind-propelled vehicle of the present invention to efficiently turn and comer such that maneuverability is enhanced at higher velocities than a vehicle with a longer axle 12 length in relation to it's frame 10.

Lift

The wind propelled vehicle of the present invention is provided lift when a sail is operably engaged to the invention and wind is propelling the invention. Lift constitutes an upward force that allows for less gravitational opposition on surfaces of the robotic sail device in contact with land, water, snow or ice and thereby results in less friction and increase speed and agility of the robotic sail device while under way. The lift is generated through the forward force of the wind engaging the sail 15 that can be attached to the mast 14. The combination of the force provided by the wind and the sweep of the mast toward the stem of the vehicle generates lift.

Center of Effort

When a sail 15 is engaged with a wind propelled vehicle of the present invention and the wind propelled vehicle is being propelled by the wind, the center of effort of the sail 15 is preferably forward of the axle 12. The center of effort being forward of the axle 12 provides for improved speed and simulates the desired physics of windsurfing. In the preferred aspect of the present invention the center of effort of the sail 15 is established at or near the geometric center of the sail 15.

Stability and Performance

Figure 7A:
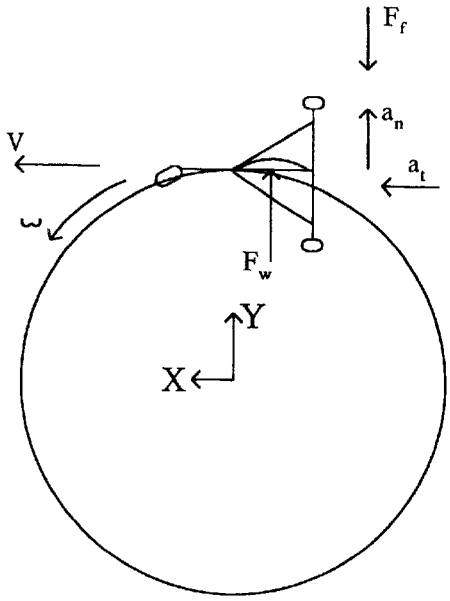
Figure 7A:
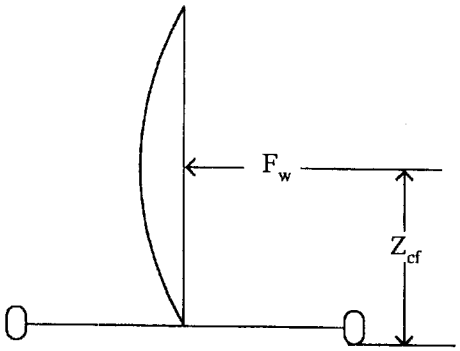
Figure 7A:
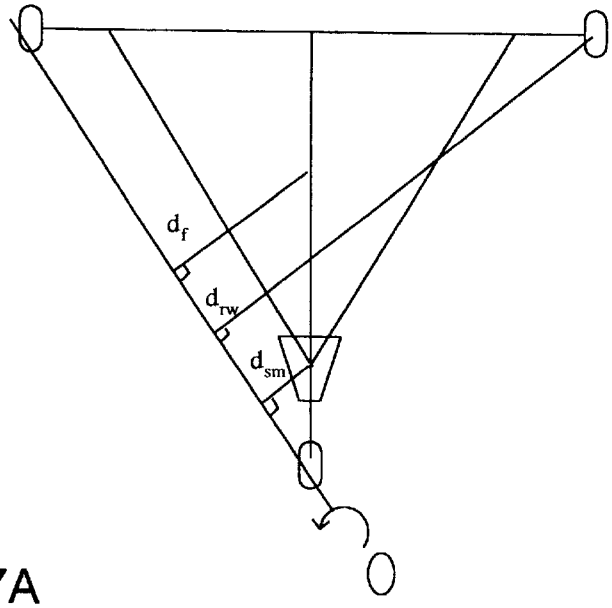

When a sail 15 is affixed to the wind propelled vehicle of the present invention and said vehicle is under way with wind, the invention exhibits the ability to perform sharp turns with a relatively small turning radius and displays enhanced stability during operation. The physics and calculations involved in describing the stability of performance of one aspect of the wind propelled vehicle of the present invention is presented in FIG. 7A and FIG. 7B.

II A Wind Propelled Vehicle that Includes At Least One Frame

The present invention includes a wind propelled vehicle that includes at least one frame 10 that includes at least one wheel 11, skid, ski or blade at a distal portion of said at least one frame 10; at least one axle 12 comprising at least one wheel 13, skid, ski or blade and at least one mast 14.

A wind propelled vehicle, comprising:

1) at least one frame comprising at least one wheel, skid, ski or blade at a distal portion of said at least one frame;

2) at least one axle comprising at least one wheel, skid, ski or blade;

3) at least one mast;

wherein a proximal portion of said at least one frame directly or indirectly operably engages said at least one axle;

wherein said at least one mast directly or indirectly operably engages said at least one frame at a distal portion of said at least one frame;

wherein when said wind propelled vehicle is operably engaged with at least one sail, the center of gravity of said wind propelled vehicle is forward of said at least one axle.

The wind propelled vehicle of the present invention can have multiples of the aforementioned elements, particularly multiple sails 15, frames 10 and axles 12. For example, a wind propelled vehicle of the present invention can have more than one frame 10. The frames 10 can be arranged in tandem such as one behind the other, next to each other or any combination thereof. The frames 10 can be positioned in a variety of configurations, such as circular, square, triangular or rectangular arrangement with the distal or front portions of each positioned in relatively the same direction. Preferably, the configuration is similar to those in sailcraft, such as sailboats, with multiple sails, but that need not be the case. The frame 10 or multiple of frames 10 can engage rotatable wheels 11,13, skids, skis, or blades, in any combination. Each frame 10 need not be individually engaged with such wheels 11, 13, skids, skis or blades. For example, multiple frames 10 can be provided in tandem on a single axle 12 or each frame 10 can have an independent axle 12. Preferably, each individual frame 10 includes a mast 14, which preferably includes a sail 15. The multiple sails 15 can be controlled by one or more sail modulating devices 23, which can act separately or in concert. The direction of the wind propelled vehicle can be controlled by one or more steering devices 20,24 that can act separately or in concert.

All publications, including patent documents and scientific articles, referred to in this application are incorporated by reference in their entirety for all purposes to the same extent as if each individual publication were individually incorporated by reference.

All headings are for the convenience of the reader and should not be used to limit the meaning of the text that follows the heading, unless so specified.

What is claimed is:

1. A wind propelled vehicle defining a center of gravity, comprising:

a frame defining a forward portion and a rear portion, a rear axle connected to said frame at said rear portion, two rear wheels rotatably connected to said rear axle, a front wheel rotatably connected to said frame at said forward portion, a mast connected to said frame, a boom connected to said mast, a sail connected to said boom and to said mast, at least one motor operably connected to said boom and to said front wheel, wherein said at least one motor is connected to said boom via a string, wherein said string comprises:

a string boom end, and a string motor end, wherein said string is connected to said boom at said string boom end and wherein said string is connected to said motor at said string motor end, and a remote control for controlling said at least one motor, wherein said at least one motor turns said front wheel and manipulates said boom in response to control signals generated by said remote control unit to adjust said sail relative to wind in order to propel said wind propelled vehicle, and wherein said center of gravity is forward of said rear axle.

2. The wind propelled vehicle as in claim 1, further comprising at least one pulley, wherein said string is directed through said at least one pulley.

3. The wind propelled vehicle of claim 1, wherein said frame is triangular.

4. The wind propelled vehicle of claim 1, wherein said frame is tubular.

5. The wind propelled vehicle of claim 1, wherein said mast slopes toward said rear portion of said wind propelled vehicle.

6. The wind propelled vehicle of claim 1, wherein said mast is curved.

7. The wind propelled vehicle of claim 1, wherein said boom is two booms.

8. The wind propelled vehicle of claim 1, wherein said boom comprises a wishbone configuration.

9. The wind propelled vehicle of claim 1, further comprising at least one restraining device.

10. The wind propelled vehicle of claim 9, wherein said at least one restraining device engages said mast.

11. The wind propelled vehicle of claim 9, wherein said at least one restraining device engages said axle.

12. The wind propelled vehicle of claim 9, wherein said at least one restraining device engages said frame.

13. The wind propelled vehicle of claim 9, wherein said at least one restraining device absorbs compression.

14. The wind propelled vehicle of claim 9, wherein said at least one restraining device reduces a need for a forestay.

15. The wind propelled vehicle of claim 1, wherein said axle has an axle length and said frame has a frame length, wherein said axle length is greater than said frame length.

16. The wind propelled vehicle of claim 1, further comprising an axle length to frame length ratio, wherein said axle length to frame length ratio is less than 2:1 and greater than 1:1.

17. The wind propelled vehicle as in claim 1, wherein said two rear wheels rotatably connected to said rear axle, are two rear skids connected to said rear axle, and wherein said front wheel rotatably connected to said frame at said forward portion is a front skid connected to said frame at said forward portion.

18. The wind propelled vehicle as in claim 1, wherein said two rear wheels rotatably connected to said rear axle are two rear skis connected to said rear axle, and wherein said front wheel rotatably connected to said frame at said forward portion is a front ski connected to said frame at said forward portion.

19. The wind propelled vehicle as in claim 1, wherein said two rear wheels rotatably connected to said rear axle are two rear blades connected to said rear axle, and wherein said front wheel rotatably connected to said frame at said forward portion is a front blade connected to said frame at said forward portion.

20. A wind propelled vehicle defining a center of gravity, comprising:

a frame defining a forward portion and a rear portion, a rear axle connected to said frame at said rear portion, two rear wheels rotatably connected to said rear axle, a front wheel rotatably connected to said frame at said forward portion, a mast connected to said frame, a boom connected to said mast, a sail connected to said boom and to said mast, at least one motor operably connected to said boom and to said front wheel, wherein said at least one motor is connected to said boom via a string, wherein said string comprises:

a string boom end, and a string motor end, wherein said string is connected to said boom at said string boom end and wherein said string is connected to said motor at said string motor end, and a remote control for controlling said at least one motor, wherein said at least one motor turns said front wheel and manipulates said boom in response to control signals generated by said remote control unit to adjust said sail relative to wind in order to propel said wind propelled vehicle.

* * * * *